US005977041A

United States Patent [19]

Honda

[11] Patent Number: 5,977,041

[45] Date of Patent: Nov. 2, 1999

[54] AQUEOUS RINSING COMPOSITION

[75] Inventor: Kenji Honda, Barrington, R.I.

[73] Assignee: Olin Microelectronic Chemicals, Norwalk, Conn.

[21] Appl. No.: 08/936,010

[22] Filed: Sep. 23, 1997

[51] Int. Cl.[6] ..... C11D 1/722

[52] U.S. Cl. ..... 510/175; 510/421; 510/434; 510/477; 510/488; 510/505; 510/506; 510/522

[58] Field of Search ..... 510/175, 421, 510/488, 505, 506, 522, 434, 477

[56] References Cited

U.S. PATENT DOCUMENTS

| | | | |
|---|---|---|---|
| 3,629,127 | 12/1971 | Palmer | 252/55 |
| 3,941,713 | 3/1976 | Dawson et al. | 252/142 |
| 4,153,545 | 5/1979 | Zwack et al. | 210/23 |
| 4,212,759 | 7/1980 | Young et al. | 252/119 |
| 4,786,578 | 11/1988 | Neissius et al. | 430/256 |
| 4,824,762 | 4/1989 | Kobayashi et al. | 430/258 |
| 4,970,008 | 11/1990 | Kandathil | 252/88 |
| 5,174,816 | 12/1992 | Aoyama et al. | 106/103 |
| 5,284,648 | 2/1994 | White et al. | 424/49 |
| 5,476,601 | 12/1995 | Bershas et al. | 252/49.3 |
| 5,612,304 | 3/1997 | Honda et al. | 510/176 |

*Primary Examiner*—Yogendra Gupta
*Assistant Examiner*—Gregory E. Webb
*Attorney, Agent, or Firm*—Ohlandt, Greeley, Ruggiero & Perle

[57] ABSTRACT

The present invention is directed to an aqueous post-strip rinsing composition, comprising (1) water; (2) at least one water-soluble organic acid; and (3) at least one water-soluble surface-active agent, the rinse solution having a pH in the range from about 2.0 to about 5.0. The present invention is also directed to a method of using the above composition to remove residues from a semiconductor substrate.

9 Claims, No Drawings

AQUEOUS RINSING COMPOSITION

BACKGROUND OF THE INVENTION

1. Field of the Invention

The present invention relates to an aqueous rinsing composition, comprising water, at least one water-soluble organic acid, and at least one water-soluble surface-active agent, the rinse solution having a pH in the range from about 2.0 to about 5.0. The present invention also relates to a process for removing residues from a substrate bearing said residues, wherein said residues comprise photoresist residues, post-etch residues, remover solution residues and combinations thereof, comprising treating the residue-bearing substrate with an aqueous rinse solution comprising water, at least one water-soluble organic acid, and at least one water-soluble surface-active agent, said rinse solution having a pH in the range from about 2.0 to about 5.0.

2. Brief Description of the Art

The manufacture of semiconductor components and integrated circuits is generally carried out using photolithographic processes. These processes involve first coating the semiconductor substrates with photoresist (positive or negative) to form a photoresist layer thereon, followed by imagewise exposing and subsequent developing to form a patterned photoresist layer on the substrate. This patterned layer acts as a mask for actual substrate patterning processes such as etching, doping, coating with metals or other semiconductor materials or other insulating materials.

After these substrate patterning operations, the patterned photoresist structure or layer must be removed from the substrate. In the past, mixtures of polar organic solvents with other compounds such as alkanolamines were used to strip this photoresist layer from the substrate. These solutions are commonly known in the art as photoresist stripping solutions. While these stripping solutions are generally effective, in some cases, a small amount of photoresist residue and stripper solution may remain on the surface of the substrate after the stripping operation.

Alternatively and more preferred at the present time, oxygen-gas plasma ashing is used to remove the photoresist layer. This plasma treatment burns the photoresist layer; however, small amounts of photoresist residue, post-etch residue and cleaner solution may still remain on the surface of the substrate in some situations.

Other methods for removing the patterned photoresist layer include mechanical means such as scrubbing with a liquid or a gas jet-stream, cryogenic treatment with liquid nitrogen, argon, or supercritical fluids, or by peeling away the layer with an adhesive-coated paper attached to the top of the photoresist layer.

When a liquid photoresist stripper solution or an oxygen gas plasma ashing step is used to remove the patterned photoresist layer, it is common to employ a subsequent liquid rinse operation. Generally, this rinse treatment involves first rinsing the substrate with an organic solvent (e.g., most commonly isopropyl alcohol) followed by a second rinsing operation with deionized water. Besides isopropyl alcohol, specific teachings of alternative organic solvent rinse solutions are described in U.S. Pat. Nos. 4,786,578 (Neisius et al.)(an organic base such as triethanolamine in combination with a non-ionic surfactant); 4,824,762 (Kobayashi et al.) (an ether compound such as dipropyleneglycol monomethyl ether and optionally, an amine compound such as monoethanolamine); and 5,174,816 (Aoyama et al.)(an aqueous solution of a quaternary ammonium hydroxide in combination with a sugar or sugar alcohol). However, the use of such organic solvent-containing rinses are not necessarily desirable because they add complexity to the photoresist removal operation and generate additional solvent waste.

In addition to photoresist residues produced by liquid stripping operations or oxygen gas plasma ashing operations or the like, other residues may form during plasma etching operations used in conjunction with photolithographic processes. For example, as explained in U.S. Pat. No. 5,174,816 (Aoyama et al.) metal halides such as aluminum chlorides may be formed as post-etch residues. Such metal halides may cause corrosion of the substrates when contacted with water.

Furthermore, during anisotropic plasma etching processes for via contacts, metal patterns and possivation openings, post-etch residues may be formed and are know in the art as sidewall polymer residues. After oxygen plasma ashing of the photoresist layer, these sidewall polymer residues become metal oxides which are generally more difficult to remove. Incomplete removal of these residues interferes with pattern definition and/or complete filling of via holes.

A new class of product called "cleaner solutions" has been developed for removing these post-etch residues, particularly the metal oxide type. These cleaners have generally been described as aqueous solutions of amines or ammonium salts that contain one or more corrosion inhibitors. See U.S. Pat. No. 5,612,304 (Honda et al.). Moreover, alkaline aqueous developers such as those containing tetramethylammonium hydroxide (TMAH) are known to attack aluminum. Thus, aluminum oxide-type residues can be etched away with TMAH. However, other types of the post-etch residues , e.g., metal fluorides such as $AlF_3$ cannot be so easily removed with TMAH without metal layer corrosion. TMAH also is ineffective on residues from polysilicon plasma etch processes.

The metal oxide type sidewall residues can also be removed with: (1) an aqueous mixture of hydrofluoric acid and ethylene glycol ether, or (2) a mixture of nitric acid, acetic acid, and hydrofluoric acid. However, these solutions require careful process control to prevent excessive attack of critical metal and oxide layers. In some device structures, these solutions are not useful because of their non-selective attack mechanisms. Also, Wai M. Lee described at Interconnects, Contact Metallization and Multilevel Metallization Symposium (183rd Spring Meeting of The Electrochemical Society) in Honolulu, Hi., May 16–21, 1993, that a hydroxylamine-containing amine/water-based stripper composition can remove some kinds of the sidewall residues.

However, there is still a need for better rinse solutions that can be used after either liquid stripper solutions or the new liquid cleaner solutions (or both), or after a dry oxygen gas plasma ashing operation, that will inhibit metal corrosion caused by the reaction of water with the above-noted types of residues, yet not contain organic solvents that require special disposal operations. It is believed the present invention offers a solution to that need.

SUMMARY OF THE INVENTION

Accordingly, one embodiment of the present invention is directed to an aqueous rinsing composition, comprising water, at least one water-soluble organic acid, and at least one water-soluble surface-active agent, the rinse solution having a pH in the range from about 2.0 to about 5.0.

Another embodiment of the present invention is directed to a process for removing residues from a substrate bearing said residues, wherein said residues comprise photoresist residues, post-etch residues, remover solution residues and combinations thereof, comprising treating the residue-bearing substrate with an aqueous rinse solution comprising water, at least one water-soluble organic acid, and at least one water-soluble surface-active agent, said rinse solution having a pH in the range from about 2.0 to about 5.0.

Another embodiment of the present invention is directed to a process for removing a patterned photoresist layer and residues comprising photoresist residues, post-etch residues, remover solution residues and combinations thereof, from a substrate which has a patterned photoresist layer thereon and which has been subjected to an etching operation, comprising the steps of:

(1) removing said patterned photoresist layer from said substrate;

(2) treating said substrate with a remover solution; and (3) rinsing said substrate with an aqueous rinse solution comprising water, at least one water-soluble organic acid, and at least one water-soluble surface-active agent, said rinse solution having a pH in the range from about 2.0 to about 5.0.

DESCRIPTION OF THE PREFERRED EMBODIMENTS

As used herein, the term "photoresist residues" refers to any amount of a photoresist layer, either patterned or non-patterned and either positive or negative, as well as any amount of degradation products of the photoresist layer remaining on the substrate. The term "post-etch residues" as used herein refers to any amount of residue that remains on a substrate after a plasma etching operation. Such residues include metal oxides, metal halides, fluorinated hydrocarbon polymers, and the like. The term "remover solution residues" as used herein refers to any amount of a remover solution remaining on a substrate surface after application of the remover solution to the substrate. The term "remover solution" as used herein includes both photoresist stripping solutions and cleaner solutions for removing post-etch residues (e.g., sidewall polymer residues) from substrates. The term "substrate" means any substrate on which a photoresist layer and remover solutions are applied, preferably to a semiconductor substrate.

As defined herein, the term "photoresist stripping" refers to chemical steps or processes that remove photoresist or other similar organic polymeric materials from a semiconductor substrate. The term "plasma etch residue cleaning" refers to chemical steps or processes that remove residual materials (also sometimes called sidewall polymers) from a semiconductor substrate that has been subjected to plasma etching. In general, both photoresist stripping and plasma-etch residue cleaning leave residual solvents on the semiconductor substrate surface that result in corrosion of the metal layer of the semiconductor substrate in contact with water if not removed completely by a subsequent rinsing step. The term "water-soluble organic acid" refers to those organic acids that are substantially dissolved in water. As used herein, the term "water soluble surface-active agent" refers to those agents that are substantially dissolved in water, and that reduces surface tension when dissolved in water or water solutions, or which reduces interfacial tension between two liquids, or between a liquid and a solid. As defined herein, the term "non-corrosive" efers to the suppression of any chemical action that gradually wears away a substrate.

As stated above, the present invention is an aqueous rinse composition comprising water, at least one water-soluble organic acid; and at least one water-soluble surface-active agent. The rinse solution preferably has a pH in the range from about 2.0 to about 5.0.

Water-soluble organic acids that are included in the aqueous post-strip rinse composition of the invention include formic acid, acetic acid, propionic acid, valeric acid, isovaleric acid, oxalic acid, malonic acid, succinic acid, glutaric acid, maleic acid, fumaric acid, phthalic acid, 1,2,3-benzenetricarboxylic acid, glycolic acid, lactic acid, citric acid, salicylic acid, tartaric acid, gluconic acid, and combinations thereof. Lactic acid, tartaric acid, acetic acid, gluconic acid, and phthalic acid are particularly preferred.

Preferred water-soluble surface-active agents that are included in the aqueous post-strip rinsing composition of the invention include oligo(ethylene oxide) compounds containing at least one acetylenic alcohol group, oligo(ethylene oxide) compounds containing at least one phosphoric ester group, oligo(ethylene oxide) compounds containing at least one carboxylic acid group, and combinations thereof.

Preferred oligo(ethylene oxide) compounds containing at least one acetylenic alcohol group that are useful in the composition of the invention have the generic formula (I):

(I)

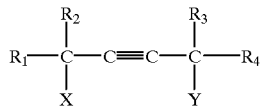

wherein $R_1$ and $R_2$ are each independently selected from $—(CH_2)_n—CH_3$ or $—CH_2—CH(CH_3)_2$; $R_3$ and $R_4$ are each independently selected from hydrogen or lower alkyl groups having 1 to 5 carbon atoms; n is an integer from 0 to 5; and X and Y are each independently selected from $—(O—CH_2—CH_2)_m—OH$ where m is an integer from 1 to 50. Particularly useful acetylenic alcohol groups attached to the oligo(ethylene oxide) backbone include 3-methyl-1-butyn-3-ol, 3-methyl-1-pentyn-3-ol, 2,5-dimethyl-3-hexyn-2,5-diol, 3,6-dimethyl-4-octyn-3,6-diol, 2,4,7,9-tetramethyl-5-decyn-4,7-diol, and 3,5-dimethyl-1-hexyn-3-ol. These surface-active agents are commercially available from Air Products and are referred to as "SURFYNOL" 400 series surfactants (e.g., SURFYNOL 420 (ethoxylated tetramethyl decynediols)).

Suitable oligo(ethylene oxides) containing at least one phosphoric ester group that are useful in the composition of the invention have the following generic formulae (II) and (III):

(II)

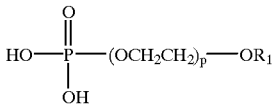

(III)

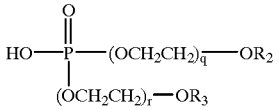

wherein $R_1$ is an alkyl group or an alkylphenyl group, either of these groups having about 8 to about 30 carbons, and $R_2$ and $R_3$ are independently selected from alkyl groups or alkylphenyl groups, either of which having about 8 to about 30 carbon atoms, and p, q and r are integers each independently selected from about 1 to about 20. These surface active agents are commercially available from Victor Chemical Works and are referred to as "VICAWET 12".

Suitable oligo(ethylene oxide) compounds containing at least one carboxylic acid group useful in the composition of the invention include 3,6-dioxaheptanoic acid, 3,6,9-trioxadecanoic acid, 3,6,9-trioxaundecanedioic acid, polyglycol diacid, and combinations thereof. This series of compounds is referred to as "oxa acids" and are commercially available from Hoechst Celanese.

The preferred amounts of the ingredients in the rinse composition are about 0.0001–1% water-soluble organic acid, about 0.0001–1% water-soluble surface-active agent, and the balance water, all based on the total weight of the rinse composition. The more preferred amounts of the ingredients in the rinse composition are about 0.001–0.1% water-soluble organic acid, about 0.01–0.5% water-soluble surface-active agent, and the balance water, all based on the total weight of the rinse solution.

Various other ingredients known to those skill in the art may optionally be included in the rinsing composition e.g. colorants, wetting agents, antifoamers and so forth. Generally, the amount of each of these optional ingredients would be about 0.0001–0.1% by weight, based on the total weight of the rinsing composition.

Preparation of the rinsing composition is carried out by dissolving or mixing the selected water-soluble organic acid component(s) and selected water-soluble surface-active agents with deionized (DI) water, optionally with slight heating at about 40–60° C. to affect dissolution so that the pH of the resulting solution is set in the range from about 2.0 to about 5.0. The resulting solution may be optionally filtered to remove undissolved particles that could harm the substrate.

The aqueous post strip rinse composition is used to treat a residue-bearing substrate, such as a semiconductor substrate. Suitable substrates include silicon, aluminum, or polymeric resins, silicon dioxide, doped silicon dioxide, silicon resins, garrium arsenide, silicon nitride, tantalum, copper, polysilicon, ceramics, and aluminum/copper alloys, polyimides, and the like. The coating surface of these substrates may or may not be primed with a conventional adhesion promotor such as hexamethyldisilazane before the photoresist coating is applied.

Preferably, the rinse treatment occurs after a removing step wherein a patterned photoresist layer is removed from the substrate. This removing step can be a stripping step which employs any suitable liquid photoresist stripper, an oxygen gas plasma ashing operation, or other conventional steps for removing the patterned photoresist layer known in the art. Also, the preliminary removing step may be a plasma-etch residue cleaning step or a combination of photoresist stripping and plasma-etch residue cleaning steps.

Such removing steps may be performed by any method known in the art of semiconductor manufacturing. Photoresist stripping generally involves removal of photoresist by a chemical stripping agent as discussed above. Plasma etch residue cleaning, on the other hand, is generally conducted after ashing the applied photoresist with a high-energy plasma to form plasma-etch by-products, for example, oxides or halides of aluminum, titanium, copper or related metals such as $AlCl_3$, $AlF_3$, $Al_2O_3$, $SiF_4$, $SiO_2$ and the like, by cleaning the resulting residue with a cleaning composition as described above. In the alternative, a combination of photoresist stripping and plasma etch residue cleaning may be utilized to remove both photoresist and plasma etch residues simultaneously. The rinsing step of the method of the invention is employed to rinse both residual photoresist stripper and plasma etch residue cleaner that remains on the surface of the substrate in order to minimize corrosion of the substrate.

The described aqueous post-strip rinse composition is used as a replacement for conventional organic solvents, such as isopropyl alcohol or N-methyl-2-pyrrolidone, employed in rinse steps following photoresist stripping or plasma etch residue cleaning. The general procedure for preparing a semiconductor substrate in accordance with the method of the invention is as follows:

A substrate, such as a silicon wafer on which a thin film of oxide is formed is uniformly coated with a photoresist composition in the form of a solution followed by drying to form a photosensitive layer which is then subjected to patterning by pattern-wise exposure to light, development treatment, and post-exposure baking to give a patterned photoresist layer. The oxide film on the substrate surface is selectively etched with the patterned photoresist layer as a mask and then the patterned photoresist layer is completely dissolved away from the substrate surface by chemical stripping or plasma etching. Any remaining chemical stripper residue or plasma etch residue is removed by a rinsing step using the composition of the invention.

The a ctual conditions of the rinse (i.e., temperature, time, and the like), may vary over wide ranges and are generally dependent on the nature and amount of photoresist stripper or plasma etch residue cleaner, as well as other factors familiar to those skilled in the art. In general, however, temperatures ranging from about 25° C. to about 45° C. for a period of about 1–3 minutes are typical.

A variety of means can be employed in contacting the rinse composition with the stripped or cleaned substrates in the practice of the method of the invention. For example, the stripped or cleaned substrate can be immersed in a rinse bath, or the rinse composition can be sprayed over the surface of the stripped or cleaned substrate, as will be apparent to those skilled in the art.

While not wishing to be bound by any particular theory, it is believed that the composition of the invention acts to reduce the corrosive effects of residual amine-based stripping or cleaning solution. The water-soluble organic acid(s) in the rinse composition neutralize corrosive species such as hydroxide ion generated by reaction of water with amine-based stripping or cleaning solution.

The rinsing composition of the invention is effective in removing and neutralizing a wide variety of stripping or cleaning solutions from substrates. Exemplary stripping or cleaning formulations include MICROSTRIP 2001 available from Olin Microelectronic Materials, a Division of Olin Corporation, EKC 265, EKC 270, EKC 311, EKC 830, all available from EKC Technology Inc.; ACT 935 available from Ashland Chemical; and PR-2000 available from Baker Chemical. All these materials are effective strippers or plasma etch residue cleaners for organic polymeric materials such as positive- and negative-working g/i-line and deep UV resists, electron beam resists, X-ray resists, ion beam resists, as well as organic dielectric materials such as polyimide resins, and the like.

EXAMPLES AND COMPARISONS

The present invention is further described in detail by means of the following examples and comparisons. However, this invention is not intended to be limited by these examples and comparisons. All parts and percentages are shown by weight percent, and all temperatures are in degrees Celsius, unless explicitly stated otherwise.

Example 1

A post-strip rinse solution made from 99.8 grams water, 0.1 grams lactic acid, and 0.1 grams SURFYNOL 420 obtained from Air Products, Inc. This solution had a pH of about 2.9 at 25° C.

Silicon wafers having a multi-layer of Al-Si-Cu/$SiO_2$/Si were prepared by plasma deposition method and then top-coated with OiR-32 positive photoresist (PR) available from Olin Microelectronic Materials of East Providence, R.I., which includes a novolak and a naphthoquinone diazide sensitizer. The photoresist was coated a film thickness of about 1.0 micron by spin coating method. Micro-patterning was applied to the PR layer photolithographically, followed by pattern transfer onto the metal layer by plasma etching with a pre-patternized PR mask. The resulting wafers contained both residues of PR and plasma etching by-products on the patternized substrate that were a mixture of silicon and aluminum oxides and halides. The exact composition of the plasma-etch residue, hereafter abbreviated by PER, was not known.

The wafers thus obtained were cut into pieces (1 cm×1 cm square) and placed in a 200 ml beaker which contained about 100 ml of a conventional alkanolamine-based stripper (MICROSTRIP 2001 obtained from Olin Microelectronic Materials) in a temperature-controlled bath at 95° C. The wafer pieces were immersed in the stripper solution and the solution was stirred gently at 90° C. for 30 minutes. The wafer pieces were then transferred to another beaker which contained the above-mentioned post-strip rinse solution at room temperature and gently stirred for 10 minutes. The wafer pieces were removed from the post-strip rinse solution and washed with deionized water for 2 minutes at room temperature, and then dried by blowing nitrogen gas onto the surfaces.

The wafer pieces were inspected under a field emission type scanning electron microscope (FE-SEM) after gold sputtering. Top-down and cross-section views of SEM pictures were obtained to visualize the wafer surfaces to see whether the residues of PR and/or PER remained, and to evaluate the metal corrosion.

The SEM inspection indicated that all the residues were completely removed without the metal corrosion.

Comparison Example 1

The procedure outlined in Example 1 was followed except using a post-strip rinse solution made by dissolving 0.1 grams of lactic acid in 99.9 grams of water. This solution had a pH of 2.9 at 25° C.

Comparison Example 2

The procedure outlined in Example 1 was again followed except using a post-strip rinse solution made from 99.94 grams water and 0.06 grams acetic acid. This solution had a pH of 3.4 at 25° C.

Comparison Example 3

The same wafer as mentioned in Example 1 was used with the same stripper solution as mentioned in Example 1. However, no post-strip rinse solution was used and two deionized water rinses were employed instead. The SEM inspection result indicated that all the residues were cleaned like Example 1 but severe metal corrosion was observed.

Table 1 indicates a summary of the test results. In Table 1, LA is lactic acid; AA is acetic acid; the surfactant is SURFYNOL 420 obtained from Air Products, Inc. "+++" in Table 1 indicates the most effective residue cleaning. "++" in Table 1 indicates moderate effectiveness of residue cleaning.

It can be concluded that:

(1) The metal corrosion can be prevented by washing the wafers with the rinse solution of the present invention after stripping before washing with water.

(2) Addition of a surfactant to a post-strip rinsing composition enhances wafer surface cleaning without substrate corrosion. SEM revealed that wafers subjected to post-strip rinsing compositions containing a surfactant experienced no surface corrosion or pitting as compared to post-strip rinsing compositions that did not contain a surfactant.

TABLE 1

| Example | Post-Strip Composition (wt %) | | | | SEM Inspection Result | | |
|---|---|---|---|---|---|---|---|
| | | | | | Residue Cleaning | | Metal Corrosion |
| No. | $H_2O$ | Acid | Surfactant | pH | PR | PER | OK |
| Example 1 | 99.8 | 0.1 (LA) | 0.1 | 2.9 | +++ | +++ | OK |
| Comp. 1 | 99.9 | 0.1 (LA) | 0 | 2.9 | ++ | ++ | OK |
| Comp. 2 | 99.94 | 0.06 (AA) | 0 | 3.4 | ++ | ++ | OK |
| Comp. 3 | 100 | 0 | 0 | NA | ++ | ++ | NG |

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. An aqueous rinsing composition, comprising:

(a) water;

(b) at least one-water-soluble organic acid selected from the group consisting of lactic acid, tartaric acid, acetic acid, gluconic acid, phthalic acid and combinations thereof; and (c) at least one water soluble surface active agent, wherein said at least one water soluble surface active agent is selected from the group consisting of:

(i) oligo(ethylene oxide) compounds containing at least one acetylenic alcohol group;

(ii) oligo(ethylene oxide) compounds containing at least one carboxylic acid group;

(iii) oligo(ethylene oxide) containing at least one phosphoric ester group in an admixture with either (i) and (ii); and (iv) combinations thereof;

wherein said rinsing composition has a pH in the range from about 2.0 to 5.0.

2. The aqueous rinsing composition of claim 1, wherein said oligo(ethylene oxide) compound containing at least one acetylenic alcohol group and having the formula (I):

(I)

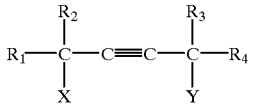

wherein $R_1$ and $R_2$ are independently selected from $—(CH_2)_n—CH_3$ or $—CH_2—CH(CH_3)_2$; $R_3$ and $R_4$ are independently selected from hydrogen or lower alkyl groups having 1 to 5 carbon atoms; n is an integer from 0 to 5; and X and Y are each independently selected from $—(O—CH_2—CH_2)_m—OH$ where m is an integer from 1 to 50.

3. The aqueous rinsing composition of claim 2, wherein said acetylenic alcohol groups of said oligo(ethylene oxide) compound containing at least one acetylenic alcohol group are selected from the group consisting essentially of 3-methyl-1-butyn-3-ol, 3-methyl-1-pentyn-3-ol, 2,5-dimethyl-3-hexyn-2,5-diol, 3,6-dimethyl-4-octyn-3,6-diol, 2,4,7,9-tetramethyl-5-decyn-4,7-diol, 3,5 -dimethyl-1-hexyn-3-ol, and combinations thereof.

4. The aqueous rinsing composition of claim 1, wherein said oligo(ethylene oxide) compound containing at least one phosphorus ester group has the formula (II) or (III):

(II)

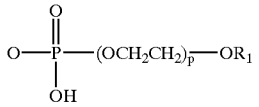

(III)

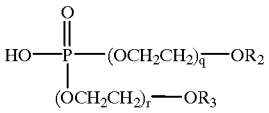

wherein $R_1$ is an alkyl group or an alklyphenyl group, each independently having from about 8 to about 30 carbon atoms; $R_2$ and $R_3$ are independently selected from alkyl groups or alkenyl phenyl groups, each independently having from about 8 to about 30 carbon atoms, and p, q and r are integers each independently selected from about 1 to about 20.

5. The aqueous rinsing composition of claim 1, wherein said oligo(ethylcne oxide) compound containing at least one carboxylic acid group is selected from the group consisting of 3,6-dioxaheptanoic acid, 3,6,9-trioxadccanoic acid, 3,6,9-trioxaundecanoic acid, polyglycol diacid and combinations thereof.

6. The aqueous rinsing composition of claim 1, wherein said rinse composition comprises from about 0.0001 to about 1% water-soluble organic acid, from about 0.0001 to about 1% water-soluble surface-active agent, and the balance water, all based on the total weight of the rinse solution.

7. The aqueous rinsing composition of claim 1, wherein said rinse composition comprises from about 0.001 to about 0.1% water-soluble organic acid, from about 0.01 to about 0.5% water-soluble surface-active agent, and the balance water, all based on the total weight of the rinse solution.

8. The aqueous rinsing composition of claim 1 further comprising the addition of optional additives selected from the group consisting of colorants, wetting agents, antifoamers, and combinations thereof.

9. The aqueous rinsing composition of claim 8 wherein said optional additives have a concentration from about 0.0001 to about 0.1 % by weight, based on the total weight of the rinsing composition.

* * * * *